United States Patent [19]

Sanzone et al.

[11] Patent Number: 4,462,116

[45] Date of Patent: Jul. 31, 1984

[54] ATHLETIC SWEATBAND

[75] Inventors: Salvatore J. Sanzone, Cedarhurst; Donald Krout, New York, both of N.Y.

[73] Assignee: Sankro Sportsline Products, Inc., Brooklyn, N.Y.

[21] Appl. No.: 192,645

[22] Filed: Sep. 30, 1980

[51] Int. Cl.[3] ..... A41D 13/08

[52] U.S. Cl. ..... 2/170; 2/160; 2/171; 2/253; 66/171

[58] Field of Search ..... 2/170, 160, 162, 171, 2/DIG. 11, 253; 66/171; 224/219, 222; D2/383, 400

[56] References Cited

U.S. PATENT DOCUMENTS

| | | | |
|---|---|---|---|
| 33,980 | 1/1901 | Mitchell . | |
| 46,081 | 7/1914 | Boch . | |
| D. 58,316 | 2/1917 | Heald . | |
| 75,458 | 3/1868 | Pratt . | |
| 248,258 | 6/1978 | Munari | D2/383 |
| 249,592 | 9/1978 | Libonati | D87/3 R |
| 252,173 | 6/1979 | Woods | D3/53 |
| 255,509 | 6/1980 | Nathan et al. | D3/59 |
| 258,246 | 2/1981 | Kravchenko | D2/383 |
| 259,220 | 5/1981 | Small et al. | D2/400 |
| 261,196 | 10/1981 | Griffin | D2/383 |
| 710,732 | 10/1902 | Anderson . | |
| 1,325,607 | 3/1918 | Barber . | |
| 1,382,446 | 6/1921 | Warren . | |
| 1,445,528 | 10/1921 | Marsh . | |
| 1,552,420 | 11/1924 | Crippen, Jr. . | |
| 1,728,365 | 4/1926 | Root et al. . | |
| 1,982,431 | 11/1934 | Hines . | |
| 2,249,550 | 7/1941 | Williams | 58/105 |
| 3,189,073 | 6/1965 | Todd | 150/35 |
| 3,189,919 | 6/1965 | Chase | 2/16 |
| 3,238,939 | 3/1966 | Stubbs | 128/165 |
| 3,256,882 | 6/1966 | Huber | 128/165 |
| 3,490,768 | 1/1970 | Archer . | |
| 3,533,407 | 10/1970 | Smith | 128/165 |
| 3,670,933 | 6/1972 | Jones | 224/28 B |
| 4,034,979 | 7/1977 | Wester | 273/54 B |
| 4,047,400 | 9/1977 | Thorneburg | 66/171 |
| 4,061,256 | 12/1977 | Beer et al. | 224/5 D |
| 4,068,318 | 1/1978 | McMahon | 2/170 |
| 4,176,407 | 12/1979 | Goebel et al. | 2/20 |
| 4,239,136 | 12/1980 | Godwin | 224/219 |
| 4,277,847 | 7/1981 | Florio | 2/DIG. 11 X |

FOREIGN PATENT DOCUMENTS

| | | |
|---|---|---|
| 0055190 | 9/1938 | Denmark . |
| 521431 | 5/1940 | United Kingdom . |

*Primary Examiner*—Peter P. Nerbun

*Attorney, Agent, or Firm*—Lalos, Leeds, Keegan, Lett, Marsh, Bentzen & Kaye

[57] ABSTRACT

An athletic sweatband generally consisting of a continuous band of material disposable about the wrist, head or ankle of a user, the band having an interior compartment communicable with the exterior of the band through an opening in the band, and an article container disposed in the band compartment having an opening communicable with the band opening.

33 Claims, 8 Drawing Figures

ATHLETIC SWEATBAND

This invention relates to an athletic sweatband and more particularly to a sweatband which may be worn on the wrist, head or ankle of an athlete while engaged in athletic activity, such as jogging and playing tennis, to carry various articles, such as keys, coins and the like.

Most persons engaged in an athletic activity, such as jogging, tennis, squash, handball and other similar sports usually are attired in brief clothing, such as shorts, T-shirts, sweatshirts and the like. Normally, such attire is lacking in pockets or other means for carrying personal effects, such as coins, keys, bills and credit cards which prevents such persons from carrying such personal effects while they pursue their sports activity. Often, such inability to carry such personal effects is a hindrance and an inconvenience, particularly if such persons are required to carry the personal effects in their hands or to insert them in their brief and usually loose clothing which can inhibit their movement or result in loss of such items. It thus has been found to be desirable to provide a means for athletes to carry personal effects with them without unduly hindering or inconveniencing them in their athletic activity.

Accordingly, it is the principal object of the present invention to provide a means for persons engaged in sports activities for carrying personal effects.

Another object of the present invention is to provide a means for persons engaged in sports activities to carry personal effects in a manner which will not unduly hinder the person's movements or be an inconvenience.

A further object of the present invention is to provide a novel piece of wearing apparel with which persons engaged in sports activities may conveniently and securely carry personal effects such as coins, paper money, keys, credit cards and the like.

Other objects and advantages of the present invention will become more apparent to those persons having ordinary skill in the art to which the present invention pertains from the following description taken in conjunction with the accompanying drawings wherein.

Figure 3:
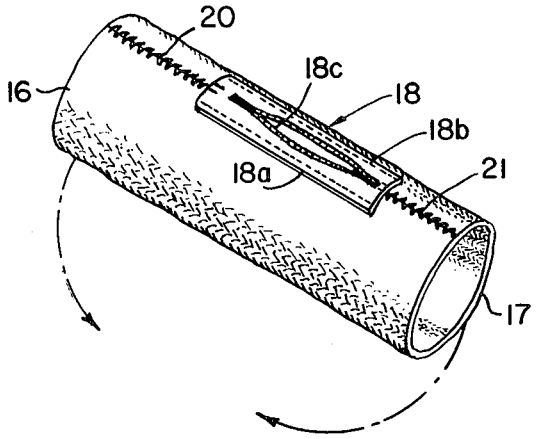
FIG. 3 is a perspective view of a sequential step in forming the embodiment shown in FIG. 1, illustrating the panel shown in FIG. 2 in a sequential condition.
Figure 4:
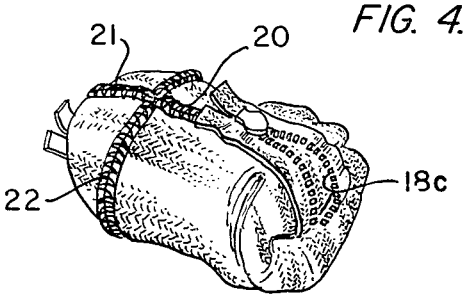
FIG. 4 is a perspective view of a sequential condition of the panel shown in FIGS. 2 and 3, illustrating the formed panel in an inverted condition.
Figure 5:
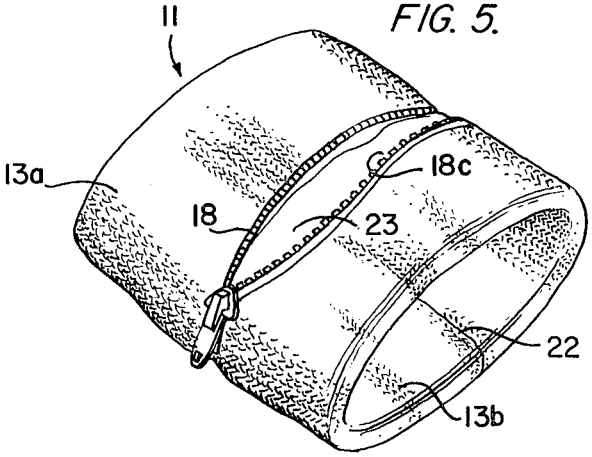
FIG. 5 is an enlarged perspective view of the article shown in FIG. 4, having been inverted.
Figure 6:
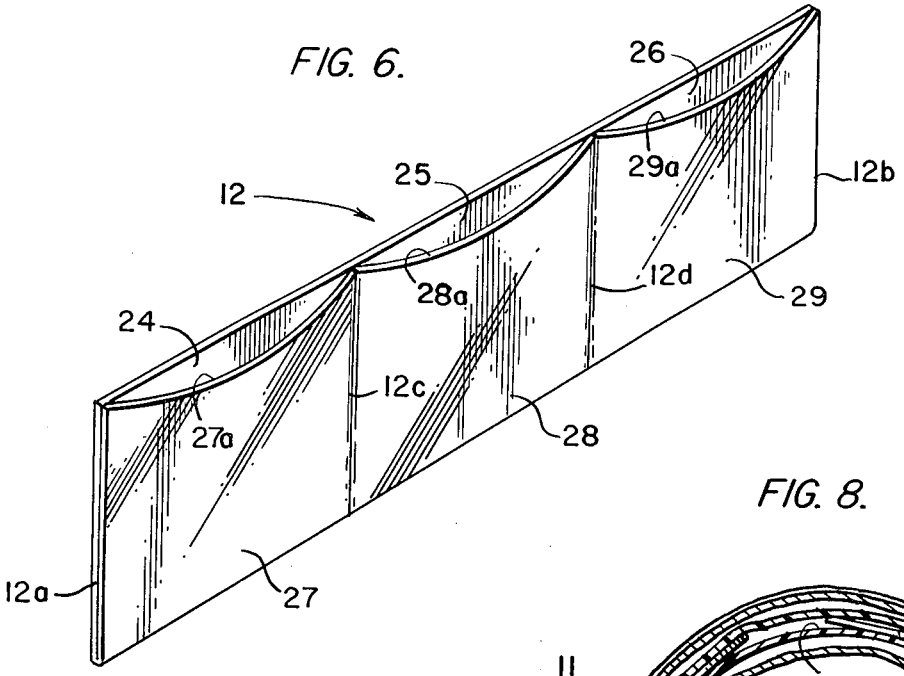
FIG. 6 is an enlarged cross-sectional view of an article container which is adapted to be inserted in an opening provided in the article shown in FIG. 5.

Referring to the drawings, there is illustrated an embodiment of the invention consisting of a wristband 10 including a band 11 formed of a stretchable, perspiration absorbent material, and a multiple compartment, article container 12 formed of a flexible, moisture impervious material. As best illustrated in FIGS. 2 through 5, band 11 is formed of a panel of material 13 which may be sewn together and inverted as will be explained to provide the article as shown in FIG. 5. Panel 13 has a substantially rectangular configuration including a pair of longitudinally disposed side edges 14 and 15 and a pair of transversely disposed end edges 16 and 17. As previously mentioned, the panel is formed of a stretchable, perspiration absorbent material. It has been found that a terry cloth type of woven fabric consisting of 90% cotton yarn interwoven with 10% elastomeric strands or a woven fabric consisting of 90% synthetic yarn, such as ANTRON yarn manufactured and sold by the Dupont Company and 10% elastomeric strands are suitable for this purpose.

Band 11 is formed by first stitching one side 18*a* of a zipper 18 along side edge 15 of panel 30, with the zipper faced down and positioned equidistantly from end edges 16 and 17. The portion of the panel farthest from zipper 18 is then folded under the portion of the panel closest to the zipper along a fold line 19 and longitudinal edge 14 is stitched to side portion 18*b* of zipper 18. The opposed portions of longitudinal side edges 14 and 15 are then stitched together as at 20 and 21 to provide a tubular article as shown in FIG. 3. The tubular article is then flattened, the zipper is unzipped and the ends of the article are stitched together to form a seam 22. Seams 20, 21 and 22 preferably are formed with a Merrow stitch. The article shown in FIG. 4 is then inverted or turned inside out through zipper opening 18*c* to provide band 11 shown in FIG. 5 having an outer ply 13*a* and an inner ply 13*b* formed integrally along the adjoining edges thereof, defining a compartment 23 therebetween.

Article container 12 is adapted to be inserted through zipper opening 18*c* and positioned in compartment 23 of article 11. The container consists of a substantially rectangular piece of flexible or pliable plastic folded over and sealed along edges 12*a* and 12*b* and intermediate lines 12*c* and 12*d* to provide a number of compartments 24, 25 and 26. The outer edges of container panels 27, 28 and 29 are provided with scooped configurations 27*a*, 28*a* and 29*a* to facilitate easy access to compartments 24, 25 and 26.

Figure 1:
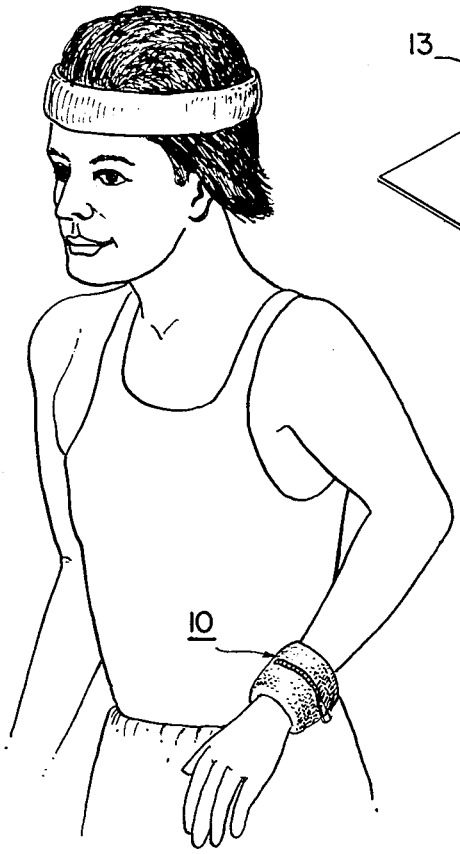
FIG. 1 is a perspective view of an embodiment of the invention shown being worn on the wrist of a jogger.
Figure 2:
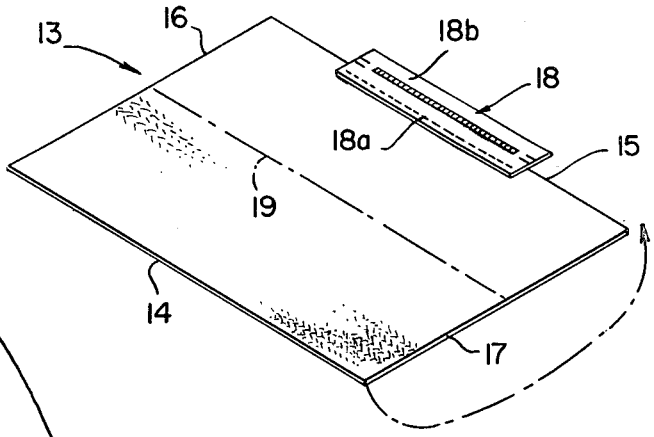
FIG. 2 is a perspective view of a panel of material from which the embodiment shown in FIG. 1 may be formed, illustrating an initial step in the process of making such an embodiment.
Figure 8:
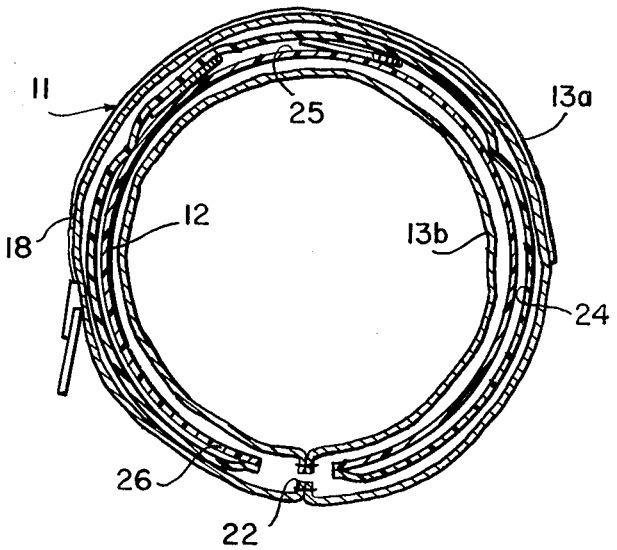
FIG. 8 is an enlarged vertical cross-sectional view taken along line 8—8 in FIG. 7.
Figure 7:
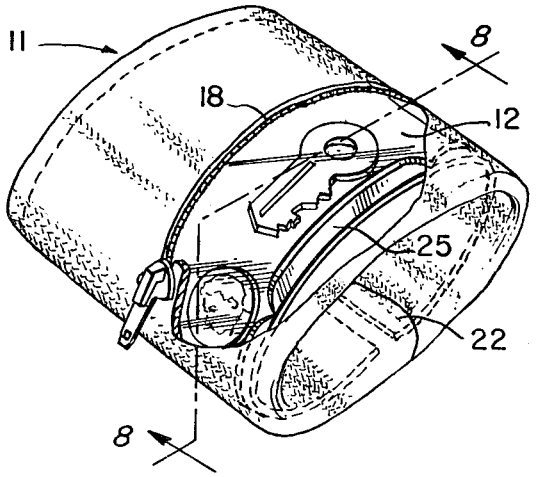
FIG. 7 is a view similar to the view shown in FIG. 5, illustrating the article container shown in FIG. 6 inserted in the article shown in FIG. 5 and having a portion of the fabric article broken away to expose the article container disposed within the fabric article.

As best illustrated in FIGS. 7 and 8, article container 12 is adapted to be disposed in compartment 23 of article 11, between outer and inner plies 13*a* and 13*b* thereof, with the access openings of container compartments 24, 25 and 26 displaced from zipper opening 18 yet communicable therewith by distorting one side of the zipper. It is contemplated that various items of personal effects, such as keys, coins, credit cards and the like may be carried in container compartments 24, 25 and 26 either by inserting the items in the container compartments prior to inserting the article container in band 11 or maneuvering such items through zipper opening 18 and into container compartments 24, 25 and 26 by distorting one side of the zipper. After the container with the items to be carried are inserted in band 11 or the individual items are inserted through the zipper opening and maneuvered into the container compartments, the outer ply of band 11 may be repositioned as shown in FIG. 5 and the zipper closed to safely and securely lock the items in the sweatband. The sweatband can then be worn on the wrist as shown in FIG. 1 to permit the user to carry the articles without hindering his or her motions. As the user continues with his or her athletic activity and begins to perspire, such perspiration about the wrist of the user will be absorbed by band 11. Such perspiration, however, essentially will be prevented from contacting the articles in the sweatband as a result of the impervious nature of the article container.

Although the embodiment of the invention shown in the drawings relates to a sweatband which may be worn on the wrist of a user, it is to be understood that by simply adjusting the size of the article, it may be worn on other portions of the body. It may used as a headband and on the arms and legs, particularly the ankle. Also, it will be appreciated that band 11 and container 12 may be made of other comparable materials. In addition, closure means other than a zipper may be used such as interlocking materials including a Velcro material.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An athletic sweatband comprising:

a continuous band of material disposable about a portion of the body of the user, said band having an interior compartment communicable with the exterior of said band through an opening in said band, and an article container disposable in said band compartment having at least one opening communicable with said band opening, said article container being insertable and removable from said compartment.

2. The athletic sweatband according to claim 1 including, said article container being formed of a flexible, moisture impervious material.

3. The athletic sweatband according to claim 1 including, said article container being formed of a plastic material.

4. The athletic sweatband according to claim 1 including, a plurality of interlocking elements being provided on opposed sides of said band opening.

5. The athletic sweatband according to claim 1 including, said article container being provided with multiple compartments, each having an opening communicable with said band opening.

6. The athletic sweatband according to claim 1 including, said band comprising a woven fabric consisting of synthetic yarn interwoven with elastomeric strands.

7. The athletic sweatband according to claim 6 including, said woven fabric consisting of 90 percent synthetic yarn and 10 percent elastomeric strands.

8. The athletic sweatband according to claim 1 including, said band comprising a woven fabric consisting of cotton yarn interwoven with elastic strands.

9. The athletic sweatband according to claim 8 including, said woven fabric consisting of 90 percent cotton yarn and 10 percent elastomeric strands.

10. The athletic sweatband according to claim 1 including, said continuous band being formed from a single piece of material.

11. The athletic sweatband according to claim 1 including, said article container including connected first and second moisture impervious sides defining at least one compartment.

12. The athletic sweatband according to claim 1 including, said band having an inner surface positionable against a portion of the body of a user when worn by the user and an opposite outer surface, said opening in said band passing through said outer surface.

13. The athletic sweatband according to claim 12 including, said band having a hollow annular shape, and said opening in said band being generally parallel to the circumference of said annular shape and positioned generally in the middle of said outer surface.

14. The athletic sweatband according to claim 1 including, said band having a hollow annular shape.

15. The athletic sweatband according to claim 14 including, said compartment having an annular shape and when said athletic sweatband is worn said compartment extends generally the entire circumference of the portion of the body about which said sweatband is disposed.

16. The athletic sweatband according to claim 1 including, said band comprising an elongated panel having a pair of edges partially joined together to provide said band opening, and a pair of end edges joined together to provide inner and outer plies defining said compartment in which said article container is disposable.

17. The athletic sweatband according to claim 16 including, said band material consisting of a stretchable, perspiration absorbent fabric.

18. The athletic sweatband according to claim 16 including, said article container being formed of a flexible, moisture impervious material.

19. The athletic sweatband according to claim 16 including, said article container being formed of a plastic material.

20. The athletic sweatband according to claim 16 including, a plurality of interlocking elements being provided on opposed sides of said band opening.

21. An athletic sweatband according to claim 16 including, said article container being provided with multiple compartments, each having an opening communicable with said band opening.

22. An athletic sweatband according to claim 16 including, said band comprising a woven fabric consisting of synthetic yarns interwoven with elastomeric strands.

23. An athletic sweatband according to claim 22 including, said woven fabric consisting of 90 percent synthetic yarns and 10 percent elastomeric strands.

24. An athletic sweatband according to claim 16 including, said band comprising a woven fabric consisting of cotton yarns interwoven with elastomeric strands.

25. An athletic sweatband according to claim 24 including, said woven fabric consisting of 90 percent cotton yarn and 10 percent elastomeric strands.

26. The athletic sweatband according to claim 16 including, said continuous band being formed from a single piece of material.

27. The athletic sweatband according to claim 16 including, said article container including connected first and second moisture impervious sides defining at least one compartment.

28. The sweatband according to claim 16 including, said band having an inner surface positionable against a portion of the body of a user and an opposite outer surface, said opening in said band passing through said outer surface.

29. The athletic sweatband according to claim 28 including, said band having a hollow annular shape, and said opening in said band being generally parallel to the circumference of said annular shape and positioned generally in the middle of said outer surface.

30. The athletic sweatband according to claim 16 including, said band having a hollow annular shape.

31. The athletic sweatband according to claim 16 including, said compartment having an annular shape and when said athletic sweatband is worn said compartment extends generally the entire circumference of the portion of the body about which said sweatband is disposed.

32. The athletic sweatband according to claim 16 including:

said elongated panel being inverted through said band opening to define said band.

33. An athletic sweatband comprising:

a continuous band of material disposable about a portion of the body of the user, said band having an interior compartment communicable with the exterior of said band through an opening in said band, an article container disposable in said band compartment having at least one opening communicable with said band opening, a plurality of interlocking elements being provided on opposed sides of said band opening, said article container being provided with multiple compartments, each having an opening communicable with said band opening, said article container being insertable and removable from said compartment, said article container including connected first and second moisture impervious sides defining at least one compartment, said band having an inner surface positionable against a portion of the body of a user when worn by the user and an opposite outer surface, said opening in said band passing through said outer surface, said opening in said band being generally parallel to the circumference of said annular shape and positioned generally in the middle of said outer surface, said band comprising an elongated panel having a pair of edges partially joined together to provide said band opening, and a pair of end edges joined together to provide inner and outer plies defining said compartment in which said article container is disposable, and said compartment having an annular shape and when said athletic sweatband is worn said compartment extends generally the entire circumference of the portion of the body about which said sweatband is disposed.

* * * * *